US006955125B1

(12) United States Patent
Mazzei et al.

(10) Patent No.: US 6,955,125 B1
(45) Date of Patent: Oct. 18, 2005

(54) PRACTICE PROJECTILE WITH SMOKE SIGNATURE

(75) Inventors: Robert Mazzei, Scotch Plains, NJ (US); Seungeuk Han, Fort Lee, NJ (US); Gordon Cheung, Hackettstown, NJ (US); Robert G. Noble, Oak Ridge, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 158 days.

(21) Appl. No.: 10/694,009

(22) Filed: Oct. 24, 2003

Related U.S. Application Data

(63) Continuation of application No. 10/087,711, filed on Feb. 26, 2002, now abandoned.

(51) Int. Cl.[7] ..... F42B 8/04
(52) U.S. Cl. ..... 102/445; 102/444; 102/498
(58) Field of Search ..... 102/444, 445, 102/498, 529

(56) References Cited

U.S. PATENT DOCUMENTS

| | | | | |
|---|---|---|---|---|
| 1,875,985 A * | 9/1932 | Edgar | 102/498 |
| 4,109,579 A * | 8/1978 | Carter | 102/513 |
| 4,218,976 A * | 8/1980 | Luebbers | 102/498 |
| 4,549,487 A * | 10/1985 | Jensen | 102/498 |
| 4,711,180 A * | 12/1987 | Smolnik | 102/445 |
| 4,898,097 A * | 2/1990 | Jordan et al. | 102/283 |
| 5,228,855 A * | 7/1993 | Frost | 434/12 |
| 6,041,713 A * | 3/2000 | Altenau et al. | 102/498 |
| 6,209,461 B1 * | 4/2001 | Riffet et al. | 102/513 |

FOREIGN PATENT DOCUMENTS

| | | |
|---|---|---|
| FR | 2579316 | * 9/1986 |
| GB | 2192696 | * 1/1988 |
| IT | 0487021 | * 5/1955 |

* cited by examiner

*Primary Examiner*—Peter M. Poon
*Assistant Examiner*—David J. Parsley
(74) *Attorney, Agent, or Firm*—Michael C. Sachs; John F. Moran

(57) ABSTRACT

A practice projectile allows for the release of flame or smoke and bang upon impact to simulate a successful deployment of the tactical cartridge. The practice projectile includes three main components: a center vent tube, a plurality of vent holes, and a plurality of vent plugs. The center vent tube compensates for the physical properties of the tactical mortar cartridge and provides a passage for an efficient release of smoke upon a fuze function. The vent holes are positioned at the rear end of the projectile body to sufficiently release pressure, flame and smoke upon a fuze function. The vent plugs seal the vent holes to protect the interior of the projectile during storage, handling, and launching.

8 Claims, 3 Drawing Sheets

PRACTICE PROJECTILE WITH SMOKE SIGNATURE

This application is a continuation of application Ser. No. 10/087,711 filed on Feb. 26, 2002 now abandoned.

GOVERNMENT INTEREST

The invention described herein may be manufactured, licensed, and used by or for the U.S. Government.

FIELD OF THE INVENTION

The present invention relates to the field of munitions, and particularly to full and short range training mortar cartridges. More specifically, the present invention relates to the family of 120 mm/81 mm/60 mm full and short range training mortar cartridges and principally to the 60 mm, M769 Full Range Practice Cartridges (FRPC).

BACKGROUND OF THE INVENTION

To provide ammunition training for its troops, the U.S. Army uses a wide variety of training cartridges for different types of gun systems. These training cartridges are designed and developed to simulate ballistics of existing tactical cartridges. They are typically designed to provide audible and visible signatures to simulate a deployment and to acquire an impact point. Typical signatures of the deployment are flash or smoke, and bang. These signatures are commonly generated by a proper function of fuze.

Training rounds are typically made fragmentation free by removing explosives for the safety of soldiers. To meet this need, non-explosive fills are commonly used for simulating physical properties including weight, the center gravity location, and moments of inertia.

The training cartridges simulate tactical cartridges with the following added advantages. They are cheaper to produce as they lack the explosive charges, they are environmentally friendly, they are more reliable, and they are safer to use especially when training new recruits. For example, the 60 mm, M766 Short Range Practice Cartridge and the 81 mm, M880 short range practice cartridge use a method to release smoke signature through the holes located around an ogive section (forward body section). These training rounds are equipped with a point detonating fuse that functions by impact. These types of training rounds are realistic and effective mortar crews for gaining hands-on experiences and target practices.

However, the signature method of M766 SRPC and M880 SRPC could be improved further. As stable projectiles fall with the nose down, and the round can dig in to the ground fast and deep. Since the vent holes for smoke release are locating on ogive section, the holes can be blocked before provide full signatures.

It would therefore be desirable to enhance this signature method as applied to the 60 mm, M769 by delaying the hole blockage during impact.

SUMMARY OF INVENTION

The present invention addresses this need and features a new design for the 60 mm, M769 Full Range Practice Cartridge (FRPC), which is ballistically similar to the M720 High Explosive (HE) mortar cartridges. This design compensates for the weight of the explosives, and allows for the release of pressure, flame and smoke upon impact to simulate the cartridge. The projectile utilizes innovate concept of balancing the weight deficiency due to absence of explosives in the projectile body, and providing a method to release a smoke signature.

To qualify as a full range practice cartridge, the present projectile meets the following 2 functional requirements:

1. The projectile is able to provide audible and visual signatures (smoke or flash, and bang) upon impact on target or ground.
2. The projectile is ballistically match or similar to the 60 mm, M720 HE mortar cartridge.

The present invention presents a projectile 100 that comprises three main components: a center vent tube, a plurality of vent holes, and a corresponding plurality of vent plugs. The primary functions of the center vent tube are to compensate for the weight of the explosives to maintain the physical properties of M720 HE projectile for retaining similar ballistics of the tactical rounds and to provide a passage for an efficient smoke release upon fuze function.

The vent holes are designed and positioned at the rear end of the projectile body (boattail section) to sufficiently release pressure, flame, and smoke that traveling through the center vent tube upon impact.

The vent holes are sealed with corresponding vent plugs to protect the interior of the projectile from dirt and moisture during storage, handling, and interior pressurization during launch. Without the vent plug, fuze may prematurely detonated by the rapid pressurization by burning propellant charges in the gun tube during launch. The plugs are designed to pop out when interior of projectile 100 is pressurized upon fuze function and to allow the release of pressure, flame, and smoke through vent holes from the center vent tube. Hence the vent plugs can also be used as an indication of a dud.

BRIEF DESCRIPTION OF THE DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion, and are shown for visual clarity and of the purpose of explanation.

DETAILED DESCRIPTION OF PREFERRED EMBODIMENTS

Figure 1:
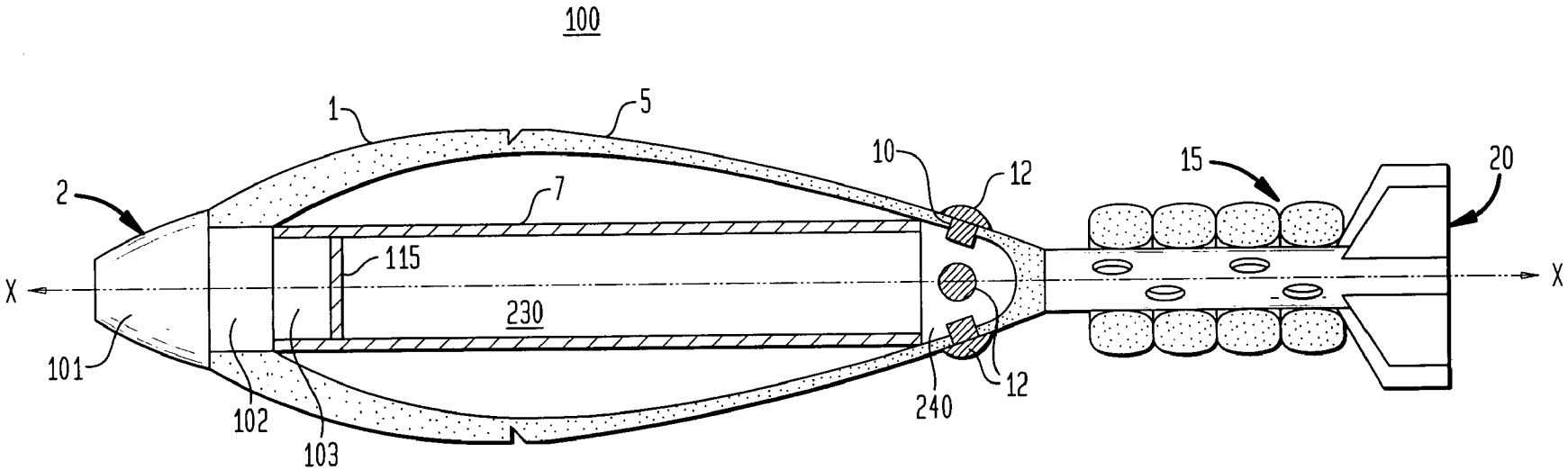
FIG. 1 is a cross-sectional view of a mortar cartridge made according to the present invention.
Figure 2:
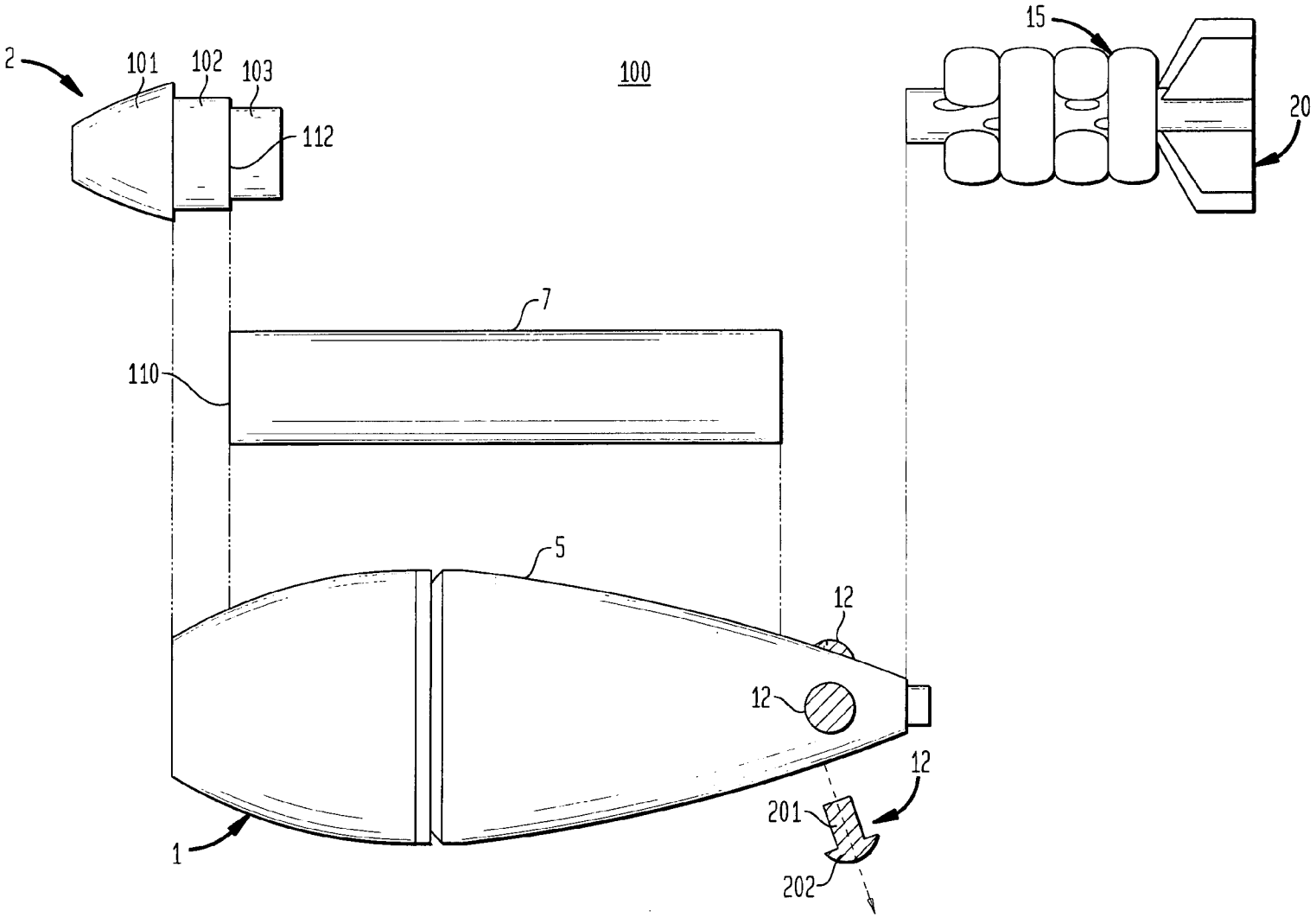
FIG. 2 is an exploded view, illustrating the components of the mortar cartridge of FIG. 1.

FIG. 1 is a cross-sectional view of the 60 mm, M769 Full Range mortar cartridge, or projectile 100, which is designed to be ballistically matched or similar to the tactical 60 mm, M720 HE mortar cartridge. With further reference to FIG. 2, the projectile 100 is generally comprised of the following components: a projectile body 1; a fuse 2; an obturator ring 3 (FIG. 2); a center vent tube 4; a plurality of vent holes 5 (more clearly illustrated in FIG. 3); a plurality of vent plugs 6; propellant charges 7; and a boom/fin/ignition cartridge assembly 8, which is also referred to herein as boom assembly 8.

These components will now be described in more detail. In a preferred embodiment, the projectile body 1 is similar to the M720 HE mortar cartridge, with the exception of the explosives, to ensure the same aerodynamic contours to achieve ballistic match or similitude.

The front end of the projectile body 1 is open and attaches to the fuse 2. The tail end of the projectile body 1 connects to the boom assembly 8.

The physical properties of the projectile 100 can are simulate those of the M720 HE mortar cartridge by adding the center vent tube 4. The center vent tube 4 provides the same or similar center of gravity location of the projectile 100 as that of the M720 HE mortar cartridge. The center vent tube 4 provides the same or similar weight for the projectile 100 as for the M720 HE mortar cartridge filled with explosives. The center vent tube 4 further provides the same or similar axial and transversal moments of inertia to the projectile 100 as those for the M720 HE mortar cartridge.

The propellant charges 7 can also be the same components as the tactical round M720 HE. The boom/fin/ignition cartridge assembly 8 is designed to provide dynamic stability during airborne operation. In addition, the boom assembly is there for holding ignition cartridge and propellant charges.

The fuze 2 is a detonating device for setting off the bursting charge to produce flash, smoke, and bang (audible and visual) for desirable observations.

The center vent tube 4 is hollow and is generally cylindrically shaped. It is mounted centrally, along the axial length of the projectile body 1, coincident with the central axis X—X of the projectile 100. The thickness of the vent tube can be various depending on the effort of locating the CG position of the projectile 100. The center vent tube 4 is mounted inside of the projectile body 1. The forward end of the center vent tube 4 is secured to the fuse rear chamber 103, which is normally need for explosives with smoke generating substances. The rear end of the center vent tube 4 is positioned at the rear end of the body 1 without blocking the vent holes 5 and any part of the vent plugs 6. Any mating sections between the center vent tube 4 and the body 1 and the fuze 2 should be properly sealed to be gap-free to prevent gas leaks during launching.

The fuze 2 has an elongated stepped shape comprised of a forward end 101, an intermediate step 102, and a narrower rearward step 103. The rearward step 103 defines an edge 112 with the intermediate step 102. The center vent tube 4 has a forward edge 110, such that when the projectile 100 is assembled, the rearward step 103 fits inside the center vent tube 4, with the forward edge 110 abutting edge 112 to secure the center vent tube 4 to the fuze 2.

The center vent tube 4 provides dual functionality. The center vent tube 4 acts as a balance weight to counter the removal of explosives to simulate the physical property of a tactical round. In this respect, the center vent tube 4 ensures the physical properties of the projectile 100 to remain generally unchanged from the tactical round. The other function of the center vent tube 4 is to act as a passage (duct) for smoke, which is generated upon fuze function, to reach the vent holes 5.

The obturator ring 3 is an O-ring used for obturation in the gun tube during launching. It is a sealant ring, which acts upon pressure forces that expel the projectile 100 from a gun barrel.

Figure 3:
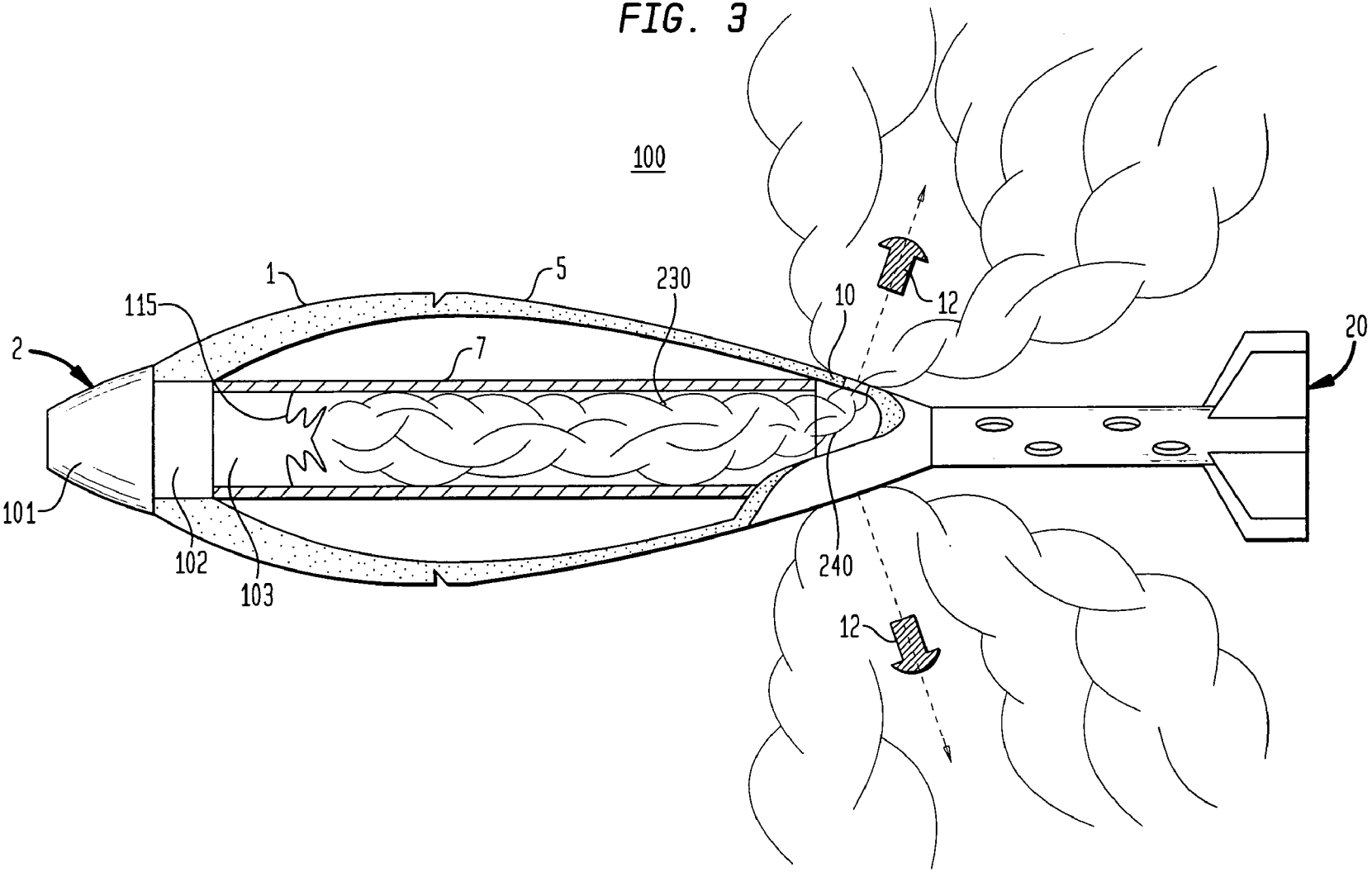
FIG. 3 is a cross-sectional view of the mortar cartridge of FIG. 3, at fuse detonation, showing a smoke having a distinctive signature, escaping through the vent holes. The vent plugs are ejected when the interior gets pressurized upon the fuze function.

As more clearly illustrated in FIG. 3, the vent holes 5 are holes (or perforations) that are formed (or drilled) through the shell of the projectile body 1, and are preferably, but not necessarily located at the rear end of the projectile body 1. Locating the vent holes toward the rear of the projectile body is for the principal of improving the smoke releasing and minimizing airflow disturbances during flight. However, the location of the hole shouldn't degrade the structural integrity of the projectile body 1. The vent holes 5 are designed to enhance the smoke signature to be released into the air without having choke or back-pressure.

A vent plug 6 is plugged in a corresponding vent hole 5 (generally press fitted). The size and number of the vent hole 5 depends upon the structure of the projectile body 1 and the internal pressure formation in the center vent tube 4 during fuze function. In a preferred embodiment the projectile 100 includes four vent holes 5 that are disposed at a 90-degree angle from each other. The vent plugs 6 will be ejected by the pressure prior to the smoke release upon fuze function.

The positions of the vent holes 5 in the rear of the projectile body 1 are important as they serve three purposes; (i) to release the pressure, flame, and/or smoke: (ii) to minimize airflow disturbances during trajectory: and (iii) to be able to release smoke even the round penetrating into the ground or a target.

Different positions of the vent holes 5 along the projectile body 1 may cause disturbances in the airflow during flight to alter its stability. A sufficient number of vent holes 5 is also important to adequately release the pressure, flame, and/or smoke into the open air. Insufficient vent hole area may increase a pressure buildup and cause the fuze to be blown-off and sheared and separated from the projectile body 1.

As shown in FIG. 2, each vent plug 6 has an elongated body 201 that terminates in an enlarged dome-shaped head 202. When the vent plug 6 is used, the plug body 201 penetrates through the corresponding vent hole 5, toward the center of the projectile body 1. The plug head 202 remains outside projectile body 1. The plug head 202 should be strong enough to resist the rapid pressure and heat buildup during launch. Elongated body 201 should design to fit the vent hole 5 tight enough to prevent accidental ejection during storage, handling, and launching, but lose enough to prevent failure of ejection at a fuze function.

The vent plugs 6 are designed to protect the components inside the projectile body 1 from severe pressurization in the gun tube during launching. Secondly, the vent plugs 6 are designed to provide protections against external environment factors such as moisture and meteorological interaction during storage and handling.

Alternatively, other designs for the vent plugs 6 can be used without departing from the scope of the invention. In addition, the vent plugs 6 can be a good design candidate to use as an indication of a dud with ensuring proper design with the intention.

Referring now to FIG. 3, it illustrates the projectile 100 at the time of fuse detonation, showing the smoke signature emanating from fuze chamber 115 and traveling through the center vent tube 4. According to the present invention, the smoke is allowed to escape through the vent holes 5 by ejecting the vent plugs 6.

Upon impact of the projectile body 1 with the intended target, the fuze 2 detonates, generating smoke rapidly fills and pressurized the center vent tube 4. The pressure pushes and ejects the vent plugs 6 out of the vent holes 5 to release flash and smoke. Audible sound is also a signature of a fuze function. Hence, flash or smoke and bang indicate a successful projectile function.

The embodiments described herein are included for the purposes of illustration, and are not intended to be the exclusive; rather, they can be modified within the scope of the invention. Other modifications may be made when implementing the invention for a particular application.

What is claimed is:

1. A practice projectile for use with a gun system, comprising:

a fuze, wherein the fuze has an elongated stepped shape comprised of a forward end, an intermediate end, and a narrower rearward step;

a hollow projectile body including an open front end and a closed rear end;

wherein the front end of the projectile is secured to the fuze;

a boom assembly secured to the closed end of the projectile body;

a center vent tube located entirely within the projectile body, having a forward end that is secured to the fuze abutting the inner wall of the projectile near the forward end of the projectile body, and a rearward end that abuts against the inner wall of the projectile body near the rear end of the projectile body, whereby an empty chamber is formed inside the hollow projectile body between the inner wall of the projectile body and the outer wall of the vent tube to form a smoke chamber and to provide added weight to control a center of gravity of the projectile, said vent tube having a wall located within, near its forward end, the wall entirely plugging the inner portion of the vent tube and disposed perpendicular to the longitudinal axis of the vent tube, the rearward step of the fuze extending into the vent tube and engaging the wall located inside the vent tube;

wherein the rear end of the projectile body includes a plurality of normally closed vent holes that are disposed in close proximity to the boom assembly, in fluidic communication with the smoke chamber; and a plurality of vent plugs that fit in the vent holes to plug the vent holes, wherein the vent plugs become unplugged from the projectile body upon function of the fuze, and allow smoke that accumulates inside the smoke chamber to be released so as to provide a signature for the projectile, said vent plugs being generally cylindrically shaped bodies with dome shaped ends, said cylindrically shaped bodies disposed inside the vent holes with a portion extending into the hollow interior of the projectile body and where said dome shaped ends extend entirely outside the projectile body and abut against the outer wall of the projectile body.

2. The projectile of claim 1, wherein the plurality of vent hole include four equally spaced apart vent holes.

3. The projectile of claim 1, wherein the plurality of vent plug includes four vent plugs.

4. The projectile of claim 1, wherein the center vent tube is generally cylindrically shaped.

5. The projectile of claim 4, wherein the center vent tube is open at both ends.

6. The projectile of claim 5, wherein the center vent tube s mounted along an axial length of the projectile body.

7. The projectile of claim 1, wherein the rearward step defines an edge with the intermediate step.

8. The projectile of claim 7, wherein the center vent tube has a forward edge, such that when the projectile is assembled, the rearward step fits inside the center vent tube, with the forward edge abutting the edge defined between the rearward step and intermediate step, to secure the center vent tube to the fuze.

* * * * *